US007753989B2

(12) United States Patent
Ernst et al.

(10) Patent No.: US 7,753,989 B2
(45) **Date of Patent: *Jul. 13, 2010**

(54) DIRECT PASSIVATION OF METAL POWDER

(75) Inventors: William Ernst, Frankfort, IL (US); Lance Jacobsen, Minooka, IL (US)

(73) Assignee: Cristal US, Inc., Woodridge, IL (US)

( * ) Notice: Subject to any disclaimer, the term of this patent is extended or adjusted under 35 U.S.C. 154(b) by 292 days.

This patent is subject to a terminal disclaimer.

(21) Appl. No.: 11/644,504

(22) Filed: Dec. 22, 2006

(65) Prior Publication Data

US 2008/0152533 A1 Jun. 26, 2008

(51) Int. Cl.
*B22F 9/28* (2006.01)

(52) U.S. Cl. ..... 75/351; 75/365; 75/367

(58) Field of Classification Search ..... None
See application file for complete search history.

(56) References Cited

U.S. PATENT DOCUMENTS

| | | | |
|---|---|---|---|
| 1,771,928 | A | 7/1930 | Jung |
| 2,205,854 | A | 6/1940 | Kroll |
| 2,607,675 | A | 8/1952 | Gross |
| 2,647,826 | A | 8/1953 | Jordan |
| 2,816,828 | A | 12/1957 | Benedict et al. |
| 2,823,991 | A | 2/1958 | Kamlet |
| 2,827,371 | A | 3/1958 | Quin |
| 2,835,567 | A | 5/1958 | Willcox |
| 2,846,303 | A | 8/1958 | Keller et al. |

(Continued)

FOREIGN PATENT DOCUMENTS

| | | |
|---|---|---|
| AU | 587782 | 11/1985 |

(Continued)

OTHER PUBLICATIONS

Kelto et al. "Titanium Powder Metallurgy—A Perspective"; Conference: Powder Metallurgy of Titanium Alloys, Las Vegas, Nevada, Feb. 1980, pp. 1-19.

(Continued)

*Primary Examiner*—George Wyszomierski
(74) *Attorney, Agent, or Firm*—Dunlap Codding, P.C.

(57) ABSTRACT

A method of producing passivated Ti or Ti alloy particles with oxygen concentrations of less than about 900 parts per million (ppm), which includes introducing a halide vapor of Ti or the metal constituents of the alloy at sonic velocity or greater into a stream of liquid alkali or liquid alkaline earth metal or mixtures thereof forming a reaction zone in which the halide is reduced by the liquid metal present in sufficient excess of stoichiometric such that Ti or Ti alloy powder from the reduction of the halide by the liquid metal is friable. After filtration and distillation excess liquid metal is removed from the Ti or Ti alloy powder that is then maintained at elevated temperature for a time sufficient to grow the particles to average diameters calculated from BET surface area measurement greater than about one micron. After cooling the Ti or Ti alloy powder to temperature of about 80° C. or less, the cooled Ti or Ti alloy powder is contacted with air and/or water to passivate the particles to produce friable metal powder and to remove other reaction products. A system for accomplishing the method is also shown.

(Continued)

43 Claims, 4 Drawing Sheets

U.S. PATENT DOCUMENTS 2,846,304 A 8/1958 Keller et al.
2,882,143 A 4/1959 Schmidt
2,882,144 A 4/1959 Follows et al.
2,890,112 A 6/1959 Winter
2,895,823 A 7/1959 Lynskey
2,915,382 A 12/1959 Hellier et al.
2,941,867 A 6/1960 Maurer
2,944,888 A 7/1960 Quin
3,058,820 A 10/1962 Whitehurst
3,067,025 A 12/1962 Chisholm
3,085,871 A 4/1963 Griffiths
3,085,872 A 4/1963 Kenneth
3,113,017 A 12/1963 Homme
3,331,666 A 7/1967 Robinson et al.
3,519,258 A 7/1970 Ishizuka
3,535,109 A 10/1970 Ingersoll
3,650,681 A 3/1972 Sugahara et al.
3,825,415 A 7/1974 Johnston et al.
3,836,302 A 9/1974 Kaukeinen
3,847,596 A 11/1974 Holland et al.
3,867,515 A 2/1975 Bohl et al.
3,919,087 A 11/1975 Brumagim
3,927,993 A 12/1975 Griffin
3,943,751 A 3/1976 Akiyama et al.
3,966,460 A 6/1976 Spink
4,007,055 A 2/1977 Whittingham
4,009,007 A 2/1977 Fry
4,017,302 A 4/1977 Bates et al.
4,070,252 A 1/1978 Bonsack
4,128,421 A 12/1978 Marsh et al.
4,141,719 A 2/1979 Hakko
4,149,876 A 4/1979 Rerat
4,190,442 A 2/1980 Patel
4,331,477 A 5/1982 Kubo et al.
4,379,718 A 4/1983 Grantham et al.
4,401,467 A 8/1983 Jordan
4,402,741 A 9/1983 Pollet et al.
4,414,188 A 11/1983 Becker
4,423,004 A 12/1983 Ross
4,425,217 A 1/1984 Beer
4,432,813 A 2/1984 Williams
4,445,931 A 5/1984 Worthington
4,454,169 A 6/1984 Hinden et al.
4,518,426 A 5/1985 Murphy
4,519,837 A 5/1985 Down
4,521,281 A 6/1985 Kadija
4,555,268 A 11/1985 Getz
4,556,420 A 12/1985 Evans et al.
4,604,368 A 8/1986 Reeve
4,606,902 A 8/1986 Ritter
RE32,260 E 10/1986 Fry
4,687,632 A 8/1987 Hurd
4,689,129 A 8/1987 Knudsen
4,725,312 A 2/1988 Seon et al.
4,828,008 A 5/1989 White et al.
4,830,665 A 5/1989 Winand
4,839,120 A 6/1989 Baba et al.
4,877,445 A 10/1989 Okudaira et al.
4,897,116 A 1/1990 Scheel
4,902,341 A 2/1990 Okudaira et al.
4,915,729 A 4/1990 Boswell et al.
4,923,577 A 5/1990 McLaughlin et al.
4,940,490 A 7/1990 Fife et al.
4,941,646 A 7/1990 Stelts et al.
4,985,069 A 1/1991 Traut
5,028,491 A 7/1991 Huang et al.
5,032,176 A * 7/1991 Kametani et al. ..... 75/416
5,055,280 A 10/1991 Nakatani et al.
5,064,463 A 11/1991 Ciomek
5,082,491 A 1/1992 Rerat
5,147,451 A 9/1992 Leland
5,149,497 A 9/1992 McKee et al.
5,160,428 A 11/1992 Kuri
5,164,346 A 11/1992 Giunchi et al.
5,167,271 A 12/1992 Lange et al.
5,176,741 A 1/1993 Bartlett et al.
5,176,810 A 1/1993 Volotinen et al.
5,211,741 A 5/1993 Fife
5,259,862 A 11/1993 White et al.
5,338,379 A 8/1994 Kelly
5,356,120 A 10/1994 König et al.
5,427,602 A 6/1995 DeYoung et al.
5,437,854 A 8/1995 Walker et al.
5,439,750 A 8/1995 Ravenhall et al.
5,448,447 A 9/1995 Chang
5,460,642 A 10/1995 Leland
5,498,446 A 3/1996 Axelbaum et al.
5,580,516 A 12/1996 Kumar
H1642 H 4/1997 Jenkins
5,637,816 A 6/1997 Schneibel
5,779,761 A 7/1998 Armstrong et al.
5,897,830 A 4/1999 Abkowitz et al.
5,914,440 A 6/1999 Celik et al.
5,948,495 A 9/1999 Stanish et al.
5,951,822 A 9/1999 Knapick et al.
5,954,856 A 9/1999 Pathare et al.
5,958,106 A 9/1999 Armstrong et al.
5,986,877 A 11/1999 Pathare et al.
5,993,512 A 11/1999 Pargeter et al.
6,010,661 A 1/2000 Abe et al.
6,027,585 A 2/2000 Patterson et al.
6,040,975 A 3/2000 Mimura
6,099,664 A 8/2000 Davies
6,103,651 A 8/2000 Leitzel
6,136,062 A 10/2000 Loffeholz et al.
6,180,258 B1 1/2001 Klier
6,193,779 B1 2/2001 Reichert et al.
6,210,461 B1 4/2001 Elliott
6,238,456 B1 5/2001 Wolf et al.
6,309,570 B1 10/2001 Fellabaum
6,309,595 B1 10/2001 Rosenberg et al.
6,409,797 B2 6/2002 Armstrong et al.
6,432,161 B1 * 8/2002 Oda et al. ..... 75/363
6,488,073 B1 12/2002 Blenkinsop et al.
6,502,623 B1 1/2003 Schmitt
6,602,482 B2 8/2003 Kohler et al.
6,689,187 B2 2/2004 Oda
6,727,005 B2 4/2004 Gimondo et al.
6,745,930 B2 6/2004 Schmitt
6,824,585 B2 11/2004 Joseph et al.
6,861,038 B2 3/2005 Armstrong et al.
6,884,522 B2 4/2005 Adams et al.
6,902,601 B2 6/2005 Nie et al.
6,921,510 B2 7/2005 Ott et al.
6,955,703 B2 10/2005 Zhou et al.
7,041,150 B2 5/2006 Armstrong et al.
7,351,272 B2 4/2008 Armstrong et al.
7,410,610 B2 8/2008 Woodfield et al.
7,435,282 B2 10/2008 Armstrong et al.
7,445,658 B2 11/2008 Armstrong et al.
7,501,007 B2 3/2009 Anderson et al.
7,501,089 B2 3/2009 Armstrong et al.
7,621,977 B2 * 11/2009 Anderson et al. ..... 75/351
2002/0050185 A1 5/2002 Oda
2002/0152844 A1 10/2002 Armstrong et al.
2003/0061907 A1 4/2003 Armstrong et al.
2003/0145682 A1 8/2003 Anderson et al.
2004/0123700 A1 7/2004 Zhou et al.
2005/0025699 A1 * 2/2005 Reed et al. ..... 423/594.17
2005/0081682 A1 4/2005 Armstrong et al.
2005/0150576 A1 7/2005 Venigalla
2005/0225014 A1 10/2005 Armstrong et al.
2005/0284824 A1 12/2005 Anderson et al.
2006/0086435 A1 4/2006 Anderson et al.

| | | | |
|---|---|---|---|
| 2006/0102255 | A1 | 5/2006 | Woodfield et al. |
| 2006/0107790 | A1 | 5/2006 | Anderson et al. |
| 2006/0123950 | A1 | 6/2006 | Anderson et al. |
| 2006/0150769 | A1 | 7/2006 | Armstrong et al. |
| 2006/0230878 | A1 | 10/2006 | Anderson et al. |
| 2007/0017319 | A1 | 1/2007 | Jacobsen et al. |
| 2007/0079908 | A1 | 4/2007 | Jacobsen et al. |
| 2007/0180951 | A1 | 8/2007 | Armstrong et al. |
| 2007/0180952 | A1* | 8/2007 | Lanin et al. ..... 75/369 |
| 2008/0031766 | A1 | 2/2008 | Ernst et al. |
| 2008/0152533 | A1 | 6/2008 | Ernst et al. |
| 2008/0187455 | A1 | 8/2008 | Armstrong et al. |
| 2008/0199348 | A1 | 8/2008 | Armstrong et al. |

FOREIGN PATENT DOCUMENTS

| | | | |
|---|---|---|---|
| AU | 2003263081 | | 6/2004 |
| CA | 2196534 | | 2/1996 |
| EA | 006615 | B1 | 2/2006 |
| EA | 007634 | B1 | 12/2006 |
| EP | 0298698 | | 1/1989 |
| EP | 0299791 | | 1/1989 |
| EP | 1441039 | | 7/2004 |
| EP | 1657317 | | 5/2006 |
| GB | 722184 | | 1/1955 |
| GB | 778021 | | 7/1957 |
| JP | 31007808 | | 9/1956 |
| JP | 49042518 | | 4/1974 |
| JP | 51010803 | | 4/1976 |
| JP | 60255300 | | 12/1985 |
| JP | 6112837 | | 1/1986 |
| JP | 62065921 | | 3/1987 |
| JP | 64047823 | | 2/1989 |
| JP | 4116161 | | 4/1992 |
| JP | 05078762 | | 3/1993 |
| JP | 10502418 | | 3/1998 |
| JP | 11090692 | | 4/1999 |
| JP | 2001279345 | | 10/2001 |
| NO | 90840 | | 1/1958 |
| SU | 411962 | | 1/1974 |
| WO | WO96/04407 | | 2/1996 |
| WO | WO98/24575 | | 6/1998 |
| WO | WO2004/022269 | | 3/2004 |
| WO | WO2004/022797 | | 3/2004 |
| WO | WO2004/022798 | | 3/2004 |
| WO | WO2004/022799 | | 3/2004 |
| WO | WO2004/022800 | | 3/2004 |
| WO | WO2004/026511 | | 4/2004 |
| WO | WO2004/028655 | | 4/2004 |
| WO | WO2004/033736 | | 4/2004 |
| WO | WO2004/033737 | | 4/2004 |
| WO | WO2004/048622 | | 10/2004 |
| WO | WO2005/019485 | | 3/2005 |
| WO | WO2005/021807 | | 3/2005 |
| WO | WO2005/023725 | | 3/2005 |
| WO | WO2005/042792 | | 5/2005 |
| WO | WO2007/044635 | | 4/2007 |
| WO | WO2007/089400 | | 8/2007 |
| WO | WO2008/013518 | | 1/2008 |
| WO | WO2008/079115 | | 7/2008 |

OTHER PUBLICATIONS

Mahajan et al. "Microstructure Property Correlation in Cold Pressed and Sintered Elemental Ti-6A1-4V Powder Compacts"; Conference: Powder Metallurgy of Titanium Alloys, Las Vegas, Nevada, Feb. 1980, pp. 189-202.

DeKock et al. "Attempted Preparation of Ti-6-4 Alloy Powders from $TiCl_4$, Al, $VCl_4$, and Na"; Metallurgical Transactions B, vol. 18B, No. 1, Process Metallurgy, Sep. 1987, pp. 511-517.

Upadhyaya "Metal Powder Compaction", Powder Metallurgy Technology, Published by Cambridge International Science Publishing, 1997; pp. 42-67.

Moxson et al. "Production and Applications of Low Cost Titanium Powder Products"; The international Journal of Powder Metallurgy, vol. 34, No. 5, 1998, pp. 45-47.

ALT "Solid-Liquid Separation, Introduction"; Ulmann's Encyclopedia of Industrial Chemistry, © 2002 by Wiley-VCH Verlag GmbH & Co., Online Posting Date: Jun. 15, 2000, pp. 1-7.

Gerdemann et al. "Characterization of a Titanium Powder Produced Through a Novel Continuous Process"; Published by Metal Powder Industries Federation, 2000, pp. 12.41-12.52.

Moxson et al. "Innovations in Titanium Powder Processing"; Titanium Overview, JOM, May 2000, p. 24.

Gerdemann "Titanium Process Technologies"; Advanced Materials & Processes, Jul. 2001, pp. 41-43.

Lü et al. "Laser-Induced Materials and Processes for Rapid Prototyping" Published by Springer, 2001, pp. 153-154.

Lee et al. "Synthesis of Nano-Structured Titanium Carbide by Mg-Thermal Reduction"; Scripta Materialia, 2003, pp. 1513-1518.

Chandran et al. "$TiB_w$-Reinforced Ti Composites: Processing, Properties, Application Prospects, and Research Needs"; Ti-B Alloys and Composites Overview, JOM, May 2004, pp. 42-48.

Chandran et al. "Titanium-Boron Alloys and Composites: Processing, Properties, and Applications"; Ti-B Alloys and Composites Commentary, JOM, May 2004 pp. 32 and 41.

Hanusiak et al. "The Prospects for Hybrid Fiber-Reinforced Ti-TiB-Matrix Composites"; Ti-B Alloys and Composites Overview, JOM, May 2004, pp. 49-50.

Kumari et al. "High-Temperature Deformation Behavior of Ti-$TiB_w$, In-Situ Metal-Matrix Composites"; Ti-B Alloys and Composites Research Summary, JOM, May 2004, pp. 51-55.

Saito "The Automotive Application of Discontinuously Reinforced TiB-Ti Composites"; Ti-B Alloys and Composites Overview, JOM, May 2004, pp. 33-36.

Yolton "The Pre-Alloyed Powder Metallurgy of Titanium with Boron and Carbon Additions"; Ti-B Alloys and Composites Research Summary, JOM, May 2004, pp. 56-59.

Research Report; P/M Technology News, Crucible Research, Aug. 2005, vol. 1, Issue 2, 2 pages.

* cited by examiner

DIRECT PASSIVATION OF METAL POWDER

FIELD OF THE INVENTION

This invention relates to the production of metals and alloys using the Armstrong Process.

BACKGROUND OF THE INVENTION

The present invention relates to the production of metals and alloys using the general method disclosed in U.S. Pat. Nos. 6,409,797; 5,958,106; and 5,779,761, all of which are incorporated herein, and preferably a method wherein titanium or an alloy thereof is made by the reduction of halides in a stream of reducing metal. Although the method disclosed herein is applicable to any of the hereinafter disclosed elements or alloys thereof, the invention will be described with respect to titanium and its alloys, simply because the available supply of titanium in the United States is now insufficient to meet the demand. Moreover, as the cost of titanium and its alloys is reduced by the use of the foregoing method, the demand will increase even beyond that already estimated by the aerospace companies and the Department of Defense.

Titanium is a very plentiful element distributed throughout the world, but it is very costly because of the antiquated methods by which it is produced. As is well known in the art, the Kroll and Hunter processes are the principal processes by which titanium is produced worldwide. Both of these processes are batch processes which produce in the first instance, a fused material of titanium and salt and excess reducing metal, magnesium for the Kroll process and sodium for the Hunter process. This fused material (known as sponge) then must be removed from the containers in which it was made, crushed and thereafter electrolytically purified in repeated steps.

The invention hereinafter described is a refinement of the Armstrong Process disclosed in the above incorporated U.S. patents.

Because titanium is an extremely reactive metal and is produced by the Armstrong Process as a very fine powder, generally with average diameters in the 0.1 to 1 micron range as calculated from BET surface area measurements, it is thereafter maintained at elevated temperature in order to increase the average particle diameter to greater than 1 micron. But, even at the large diameters, the powder is difficult to handle unless it has been passivated. By passivation, it is meant that a small amount of oxygen is introduced to the powder to form titanium dioxide on the surface so that the powder is not incendiary when exposed to air. Too much oxygen will increase the oxygen content beyond the ASTM specification for CP titanium grade 2 or for ASTM grade 5 titanium, that is 6/4 alloy (6% Al, 4% V by weight with the balance Ti). Heretofore, it was believed that the only practical way to passivate titanium powder was to bleed an inert gas such as argon with a very small percentage of oxygen for a time sufficient to increase the oxygen content on the surface of the powder to prevent spontaneous combustion when exposed to air. The times for passivation were measured in hours and was a design issue for large scale commercial plants based on a continuous process.

However, it has been unexpectedly and surprisingly found that passivation of titanium powder and/or titanium alloy powder can be accomplished by direct exposure to air and/or water and/or brine under certain conditions, which not only decrease the passivation time but also simplifies equipment design, thereby making the process simpler, more efficient and less expensive.

SUMMARY OF THE INVENTION

Accordingly, it is a principal object of the present invention to provide a method of producing passivated friable metal powder without the previous requirements for long periods of passivation.

Another object of the present invention is to provide a method of producing passivated metal powder, comprising introducing a metal halide vapor into a stream of liquid alkali or liquid alkaline earth metal or mixtures thereof forming a reaction zone in which the halide vapor is reduced by the liquid metal present in sufficient excess of stoichiometric such that the metal powder from the reduction of the halide vapor by the liquid metal is friable, separating at least most of the excess liquid metal from the reaction products, growing the metal powder until the particles forming the metal powder have average diameters calculated from BET surface area measurement greater than about one micron, cooling the metal powder, and contacting the cooled metal powder directly with air and/or water and/or brine to passivate and produce friable metal powder.

Another object of the invention to provide a method of producing passivated metal powder, comprising introducing a halide vapor of the metal into a stream of liquid sodium or liquid magnesium metal forming a reaction zone in which the halide is reduced by the liquid sodium or magnesium metal present in sufficient excess of stoichiometric such that the metal powder formed by the reduction of the halide vapor by the liquid sodium or magnesium metal is friable, separating reaction products from at least most of the excess sodium or magnesium metal, maintaining the metal powder at elevated temperature for a time sufficient to grow the powder until the particles forming the powder have average diameters calculated from BET surface area measurement greater than about one micron, cooling the metal powder to less than about 100° C., and contacting the cooled metal powder with air and/or water and/or brine to passivate and produce friable metal powder.

Yet another object of the invention is to provide a method of producing passivated Ti or Ti alloy powder with oxygen concentrations of less than about 1800 parts per million (ppm), comprising introducing a halide vapor of Ti or the metal constituents of the alloy into a stream of a liquid alkali or a liquid alkaline earth metal or mixtures thereof forming a reaction zone in which the halide is reduced by the liquid metal present in sufficient excess of stoichiometric such that Ti or Ti alloy powder from the reduction of the halide by the liquid metal is friable, separating Ti or Ti alloy powder reaction products from at least most of the excess liquid metal, maintaining the Ti or Ti alloy powder at elevated temperature for a time sufficient to grow the particles forming the Ti or Ti alloy powder to average diameters calculated from BET surface area measurement greater than about one micron, cooling the Ti or Ti alloy powder, and directly contacting the cooled Ti or Ti alloy powder with one or more of air and water and brine to passivate and produce friable powder while maintaining the oxygen concentration below about 1800 ppm.

Still a further object of the invention is to provide a method of producing passivated Ti or Ti alloy particles with oxygen concentrations of less than about 900 parts per million (ppm), comprising introducing a halide vapor of Ti or the metal constituents of the alloy at sonic velocity or greater into a stream of liquid alkali or liquid alkaline earth metal or mixtures thereof forming a reaction zone in which the halide is reduced by the liquid metal present in sufficient excess of stoichiometric such that Ti or Ti alloy powder from the reduction of the halide by the liquid metal is friable, separating by filtration and distillation excess liquid metal from the Ti or Ti alloy powder at least in part under vacuum, maintaining the Ti or Ti alloy powder at elevated temperature in a vacuum or an inert atmosphere or a combination thereof for a time sufficient to grow the particles forming the powder to average diameters calculated from BET surface area measurement greater than about one micron, cooling the Ti or Ti alloy powder to temperature of about 70° C. or less, and contacting the cooled Ti or Ti alloy powder with air to passivate the particles while maintaining the oxygen concentration of the powder below about 900 ppm, and washing the passivated powder to produce friable metal powder and to remove other reaction products.

A final object of the invention is to provide a system producing passivated and friable metal particles, comprising a storage container holding a supply of halide of the metal or alloys to be produced, a storage container holding a supply of reducing metal, pump mechanism establishing a flowing stream of liquid reducing metal, mechanism including nozzles for introducing halide vapor into the flowing stream of liquid reducing metal forming a reaction zone and producing reaction products of metal powder and a halide salt, wherein the liquid metal is present in a stoichiometric excess sufficient to maintain the temperature of the reaction products away from the reaction zone below the sintering temperature of the metal powder, separation equipment including one or more of filtration mechanism, distillation mechanism, mechanism for contacting reaction products with hot and/or cold gas for heating and/or cooling reaction products and for separating reducing metal from the metal powder while growing the particles forming the metal powder to have average diameters calculated from BET surface area measurement greater than about one micron, and mechanism contacting cooled metal powder with air and/or water and/or brine to passivate and produce friable metal powder and to separate the salt from the friable metal powder.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE INVENTION

Figure 1:
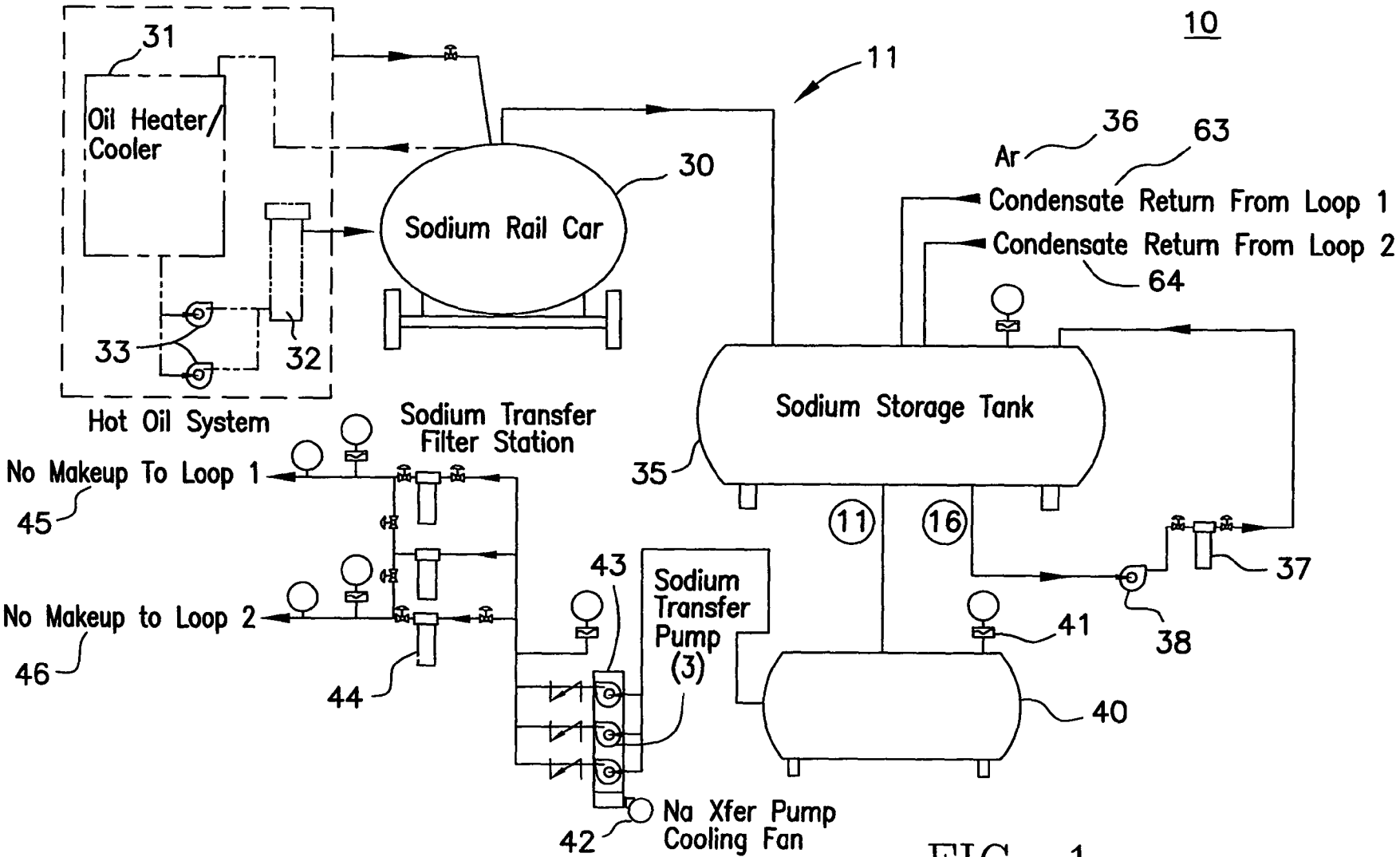
FIGS. 1-4 are schematic representations of various portions of the system and equipment used in the method herein described to produce friable passivated metal powder.

Referring to the drawings, there is disclosed a system 10 from which is produced friable and passivated metal powder. The metals and the alloys of which may be made according to the system hereinafter described are Ti, Al, Sn, Sb, Be, B, Ta, Zr, V, Nb, Mo, Ga, U, Re, Si or alloys thereof, all as previously disclosed in the above referenced and incorporated patents. The system 10 includes a sodium supply system 11, a chloride supply system 12, a reactor 15, a distillation system 16, a growing system 17, a cooling system 18, a washing system 19 and a drying system 21.

Although described herein with respect to chlorides and sodium reducing metal, it is clear that any halide may be used and a wide variety of alkali and alkaline earth metals or mixtures may be used. Commercially, sodium and magnesium are the most common reducing metals in the reduction of, for instance, titanium. Calcium has been used as a reducing metal in Russia. Although the system hereinafter described is specific to the chloride and to sodium, it is specifically intended that the invention is not so limited.

The sodium system 11 includes a sodium source 30 such as a common rail car, which is in communication with a heater 31 in order to liquify the sodium. The sodium heating system includes filters 32 with the requisite pumps 33 necessary to liquify sodium in a rail car 30 for transfer to sodium storage or an intermediate tank 35. The storage or intermediate tank 35 is provided with an inert atmosphere such as argon and is connected to a sodium substorage tank 40 which is provided with a pressure transmitter 41. Because the sodium in sodium storage tank 35 is liquid, there is a recirculation loop provided through filter 37 and a pump 38 which simply circulate sodium while it remains in the sodium storage tank and of course, there is provided the usual temperature sensors, pressure sensors and other engineering devices, not shown for purposes of clarity and brevity.

As used in the drawings, PT is a pressure transmitter, PSV is a relief valve; PSE is a rupture disc; PSH is a pressure switch; FT is a flow transmitter and CV is a flow control valve. These standard engineering sensors and controls will not be further described.

The sodium supply system 11 further includes a cooling fan 42 in conjunction with a series of sodium transfer pumps 43 which may be electromagnetic and filters 44 for pumping sodium from the storage tanks 35 and 40 to a sodium make-up 45 for loop one, and sodium make-up 46 for loop 2.

The system 10 is configured for two reactor modules as each reactor module can produce 2 million pounds of titanium or titanium alloy, or other metal alloys as previously set out, per year, so that a 4 million pound a year plant would have two operational reactors 15, whereas a 40 million pound plant would have 20 operational reactors 15.

Figure 3:
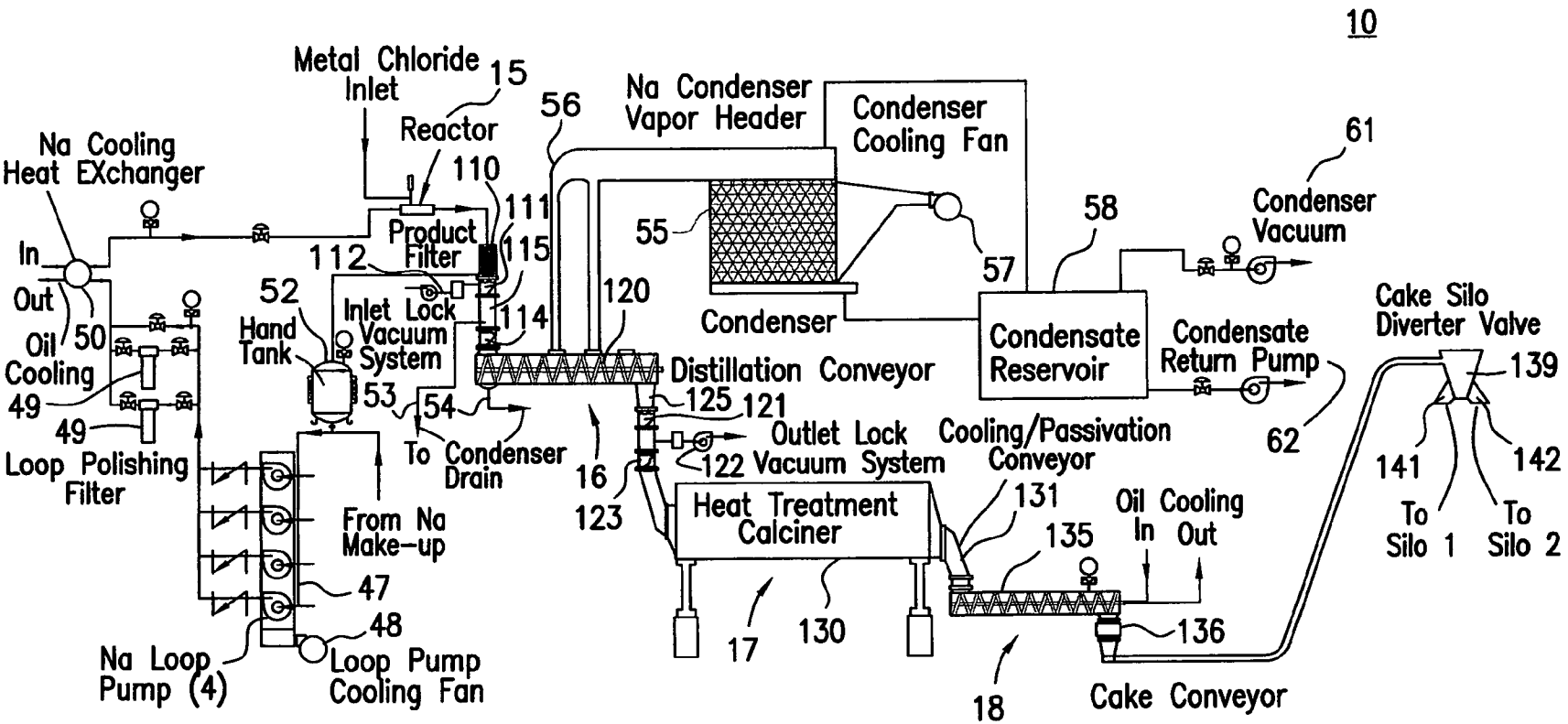

As seen particularly in FIGS. 1 and 3, sodium from the make-up loop 45, 46 is introduced via pumps 47 and cooling fan 48 into a series of filters 49 and heat exchanger 50 into the reactor 15. A head tank 52 for sodium is also included in the system 10 and is in communication with the line in both the make-up loops 45, 46. Finally, the sodium supply system 11 includes condenser drains 53 and 54 which are in communication with the reaction products that come out of the reactor 15, as seen in FIG. 3 along with a condenser 55 that is connected by a sodium condenser vapor header 56, a cooling fan 57 and a condensate reservoir 58. A condenser vacuum pump 61 and a condensate return pump 62, connected to the condensate return 63 and/or condensate return 64 are in communication with the storage tank 35, all as will be hereinafter explained, to complete the Na loop.

Figure 2:
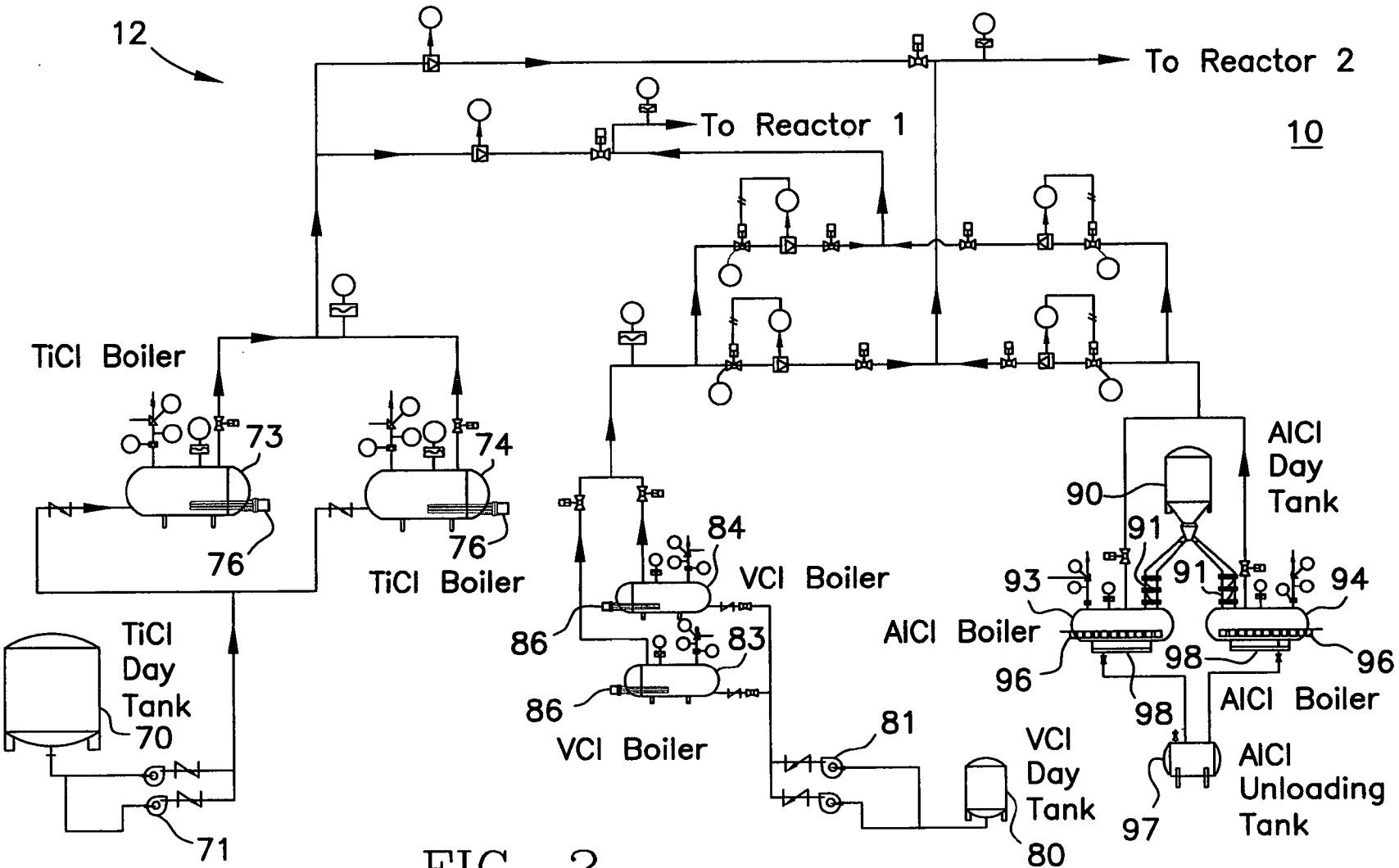

Referring to FIG. 2, there is disclosed the halide or chloride supply system 12 in further detail and includes for titanium tetrachloride feedstock, a titanium tetrachloride day tank 70 in communication with a much larger supply of titanium tetrachloride, not shown. The tank 70 is in communication via a series of pumps 71 with a pair of titanium tetrachloride boilers 73 and 74, each of which has its own heater 76. As previously stated, the description herein is for a two reactor 15 system, that is two modules as shown in the incorporated patents, therefore, there is as described, two boilers, one for each reactor. It is clear to one of ordinary skill in this art that should there be more reactors, there will be more boilers and if an alloy is to be produced, there will be boilers for each alloy constituent.

For an alloy such as the most commonly used 6/4 titanium alloy consisting essentially of 6% aluminum and 4% percent vanadium and described as ASTM B 265, grade 5, Ti 5 alloy, there has to be provided a vanadium chloride boiler 83 and a vanadium chloride boiler 84 connected by pumps 81 to a vanadium chloride day tank 80. Each of the vanadium chloride boilers 83 and 84 is provided with its own heater 86 and is connected by various piping manifolds to the reactors 15 as hereinafter will be set forth. Similarly, a aluminum chloride day tank 90 is provided and is connected by a series of valves 91 to aluminum chloride boilers 93 and 94. Each of the boilers 93 and 94 is provided with a heater 96 and unloading tank 97 and scales 98 in order to weigh the amount of aluminum chloride which is used in the production of the alloy. The difference between the system for aluminum chloride and vanadium chloride is that aluminum chloride is a solid at room temperature and may be transmitted as a solid through the valves 91 from the day tank 90 to the boilers 93. The scales 98 are used to ensure the correct amount of aluminum chloride is thereafter provided to the boilers 93 and 94. As indicated, the various halides or chlorides of the alloy constituents are fed from the boilers via pipes, valves and the like to a common pipe or manifold prior to the entry into the associated reactor 15 with the liquid reducing metal such as, but not limited to liquid sodium or liquid magnesium flowing there through.

Referring now to FIG. 3, the liquid reducing metal such as sodium from the heater exchanger 50 is introduced into the reactor 15 as a stream and the metal chloride(s) is introduced into the stream of liquid reducing metal at least sonic velocity in order to prevent back-up of the liquid metal into the halide supply and there is produced in the reactor a reaction product of metal powder which may be an alloy, a salt and the excess reducing metal present. As understood, the ratio of excess to stoichiometric reducing metal to the amount of halide will enable the steady state reaction temperature to be maintained at prescribed values, a short distance downstream from the reaction zone which is produced when the vapor halide is injected or introduced into the stream of molten metal. The exact temperatures inside the reaction zone are unknown, but a few inches downstream, the steady state temperatures have been measured and controlled anywhere from about 800° C. to about 300° C. or less for sodium and titanium tetrachloride. The stoichiometric excess preferably is between 10 and 100 times that necessary to produce the metal powder, the greater excess of metal the lower the steady state temperature will be. There is an engineering trade-off between running at higher temperatures and using additional excess liquid reducing metal to maintain a lower steady state temperature, all of which is within the ordinary skill of the art. Should magnesium be used rather than sodium, then higher running temperatures will be required because of the melting temperature of magnesium.

The reactor 15 is operated in a protective atmosphere and preferably in an argon atmosphere. Alternative inert gases such as helium may be used. The reaction products from the reactor are connected to a filter 110 which permits liquid reducing metal to be drawn therefrom into the head tank 52 and then back into the sodium supply system 11.

The filter 110 is provided with a valve 111 and is connected to a vacuum system 112 so that a collection pipe 115 surrounded on one side by valve 111 and on the other side by valve 114 is under vacuum and sodium draining from the reaction products slurry of metal powder and salt is directed through a filter (not shown) to a line to condenser drain 53 and hence back to the sodium supply system 11.

From the collection pipe 115 the material, now free of most of the sodium or liquid reducing metal, is introduced into a distillation screw conveyor 120, the screw conveyor being provided with an outlet 125 or collection pipe and two valves 121 and 123, so as to connect the distillation screw conveyor to a vacuum system 122 and insulate the distillation conveyor from the heat treatment calciner 130, as will be explained.

As material is moved by the distillation conveyor 120 in the form of an auger, sodium drained from the distillation conveyor 120 is conducted via a line to condenser drain 54 and returned to the sodium supply 11. Since the distillation screw conveyor 120 is connected by a header 56 to the condenser 55, cooling fan 54 and condensate reservoir 58, the reducing metal vapor is removed in the distillation screw conveyor and again returned as previously described by the pumps 62 to the sodium supply system 11.

It is clear that the majority of the excess sodium in this system is removed from the product and returned to the sodium supply system leaving only entrained sodium and sodium used in the production of the salt which is lost. The salt may or may not be split electrolytically to recirculate the sodium, depending on economics.

The growing station 17 is illustrated particularly in FIG. 3 and includes a rotating drum calciner 130 connected to the outlet of the distillation conveyor 120 via the valves 121 and 123. The calciner 130 rotates, as is known in the art, and material therein after a residence time predetermined by engineering principles is transmitted via an outlet 131 to the cooling and passivation system 18 which includes a screw conveyor having an outlet 136. The cooling conveyor 135 uses oil cooling as does a majority of other heat exchangers in the subject system 10 due to the presence of liquid sodium or liquid magnesium, both of which would be explosively reactive in the presence of water. Because the material in the calciner 130 is at elevated temperature, it should be present either a protective atmosphere such as an inert gas, preferably argon.

Figure 4:
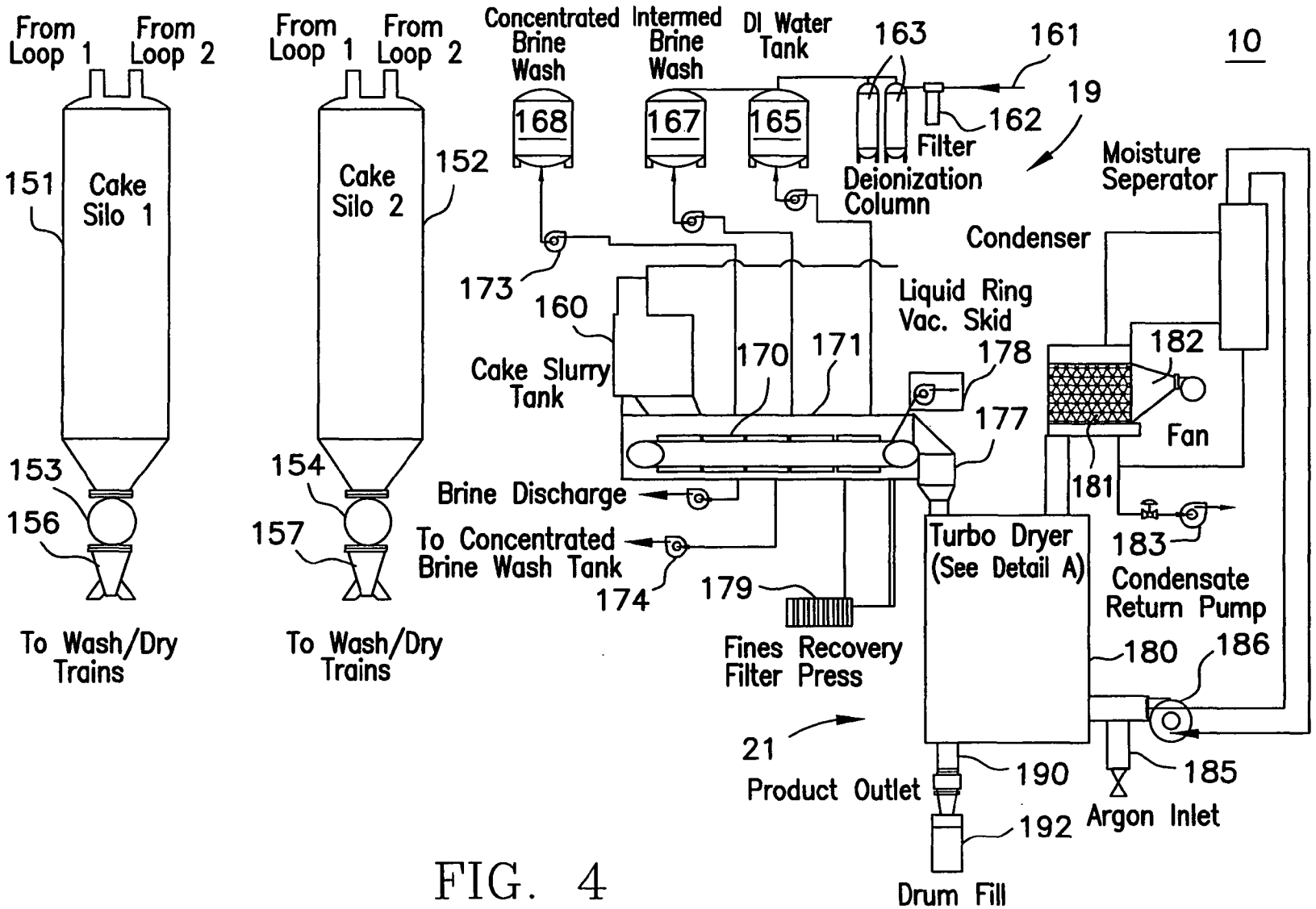

The cooling and passivation conveyor 135 reduces the temperature of the material therein from the temperature in the calciner 130 which preferably is somewhat in the excess of 700° C. preferably about 750° C., down to less than 100° C. at the outlet 136 and preferably about 80° C. or less. At this point in the process, almost all of the sodium except for that entrained within the particles has been removed, and the remaining reaction products, that is a mixture of salt and metal powder, are conveyed to the cake silo diverter valve 139 and hence through outlets 141 and 142 to the cake storage silo 151 and 152, as best seen in FIG. 4. The cake is accumulated in the storage silos until the rotary valves 153 and 154 are operated to send the material via a diverter 156 or 157 to a cake slurry tank 160, wherein the cake is formed into a slurry by means of a water supply 161 connected to the tank forming a slurry therein which is then introduced into a vacuum belt filter 170 that is connected to a vacuum system 178. Water for the slurry formed in the slurry tank 160 is provided from a supply 161 which is passed through a filter 162 and a variety of optional deionization columns 163 into a clean water tank 165. Clean water from the tank 165 flows to the cake slurry tank 160 and to the outlet portion of the vacuum belt filter 170. The vacuum belt filter 170 is contained within a housing 171 and has spray nozzles longitudinally spaced there along connected to an intermediate brine wash tank 167 and a concentrated brine wash tank 168 by suitable pumps 173. Water or brine draining through the powder on the conveyor 170 is either returned via a pump 174 to the appropriate tank 168 or to a brine discharge facility or system, not shown. As seen, powder on the conveyor belt filter 170 is initially contacted with brine and thereafter with water having lesser concentrations of salt until finally contacted with cleaner water from tank 165, which may be heated.

The cake silos 151, 152 are at temperatures less than 100° C. preferably 80° C. or less, and most preferably 40°-80° C. The washed powder outlet chute 177 connected to the vacuum belt filter 170 directs powder which has been passivated and washed with water and/or brine to an inerted turbo dryer 180. A fines collection filter press 179 is in communication with the powder conveyor housing 171 near the outlet chute 177 to collect fines from the conveyor 170.

The inerted turbo dryer 180 is connected to a condenser 181, a condenser fan 182 and condensate return pump 183 through which the moisture is removed from the passivated and now friable powder, the moisture being returned or disposed of as economics dictate. The inerted turbo dryer 180, as previously stated, is under a protective atmosphere such as argon or nitrogen, and therefore, an argon or nitrogen inlet 185 is connected to protection to the powder after passivation while it is at elevated temperatures.

Finally, a product outlet 190 leads from the turbo dryer 180 to a series of drums 192 which may be stationed beneath the outlet 190 and filled at a rate according to the system design.

Operationally, and by way of example only, without limiting the invention, the sodium storage tank is preferably maintained at an elevated temperature so that the sodium therein is liquid. The melting point of sodium is about 98° C. so that the sodium storage tanks 35 and 40 are maintained about 105° C. whereas the sodium head tank 52 is maintained at about 125-300° C., preferably about 125° C. Exact temperatures and/or pressures hereinafter set forth are subject to engineering considerations so the ranges are by way of example only and are not intended to limit the invention.

The titanium tetrachloride boilers 73, 74 are maintained at about 220° C. resulting in pressures of about 500 kPa but may be at pressures up to about 800 kPa. Both the vanadium chloride boilers 83, 84 as well as aluminum chloride boilers 93, 94 are maintained at pressures greater than the titanium tetrachloride boilers because the vapors from each of the alloy constituent boilers have to be at pressures greater than the titanium chloride boilers so as to prevent titanium chloride from backing up into the alloy constituent boilers. For instance, if the titanium tetrachloride boilers 73, 74 are at 500 kPa, then the $VCl_4$, $AlC_4$ boilers are maintained at about 800 kPa.

The reactor 15 may be operated with an inlet temperature of about 260° C. with the outlet temperature about 100° C. greater, or about 360° C. Higher or lower inlet temperatures are possible. The distillation conveyor 120 is preferably, but not necessarily, operated at about 538° C. but may be operated from about 450° C. up to about 550° C. depending on the vacuum value of the system, the better the vacuum the lower the distillation temperature can be. The calciner 130 is preferably operated at about 750° C. for approximately 6 hours in order to grow the metal particles forming the powder. Again, engineering considerations are taken into account between the equipment size, residence time and the temperature at which the particle growth is maintained. Temperatures of 700° or above are practical, but again, the lower the temperature, the longer the residence time in order to achieve the same particle growth. The cooling passivation conveyor 135 preferably has an inlet temperature which is generally equal to the outlet temperature of the calciner 130 such as about 750° and an outlet temperature preferably in the range of between about 40° C. to 80° C. The higher the outlet temperature the greater the oxygen pick-up of the metal powder, but temperatures in the range of from about 40° C. to about 80° C. are preferred with 40° C. providing better results than the 80° C. temperature.

The cooling and heating in the system 10 is by means of heat transfer through coils in which oil is used as a heat transfer medium for safety considerations. The silos 151 and 152 are generally operated at ambient temperatures in air and stay principally at the temperatures in which the powder is introduced from the conveyor 135, that is in the range between about 40° C. and 80° C. Washing after air passivation or directly without air passivation is done at ambient temperature and the last wash, that is water from the fresh water tank 165 may be warmed to facilitate dissolving salt and warming the powder for entry into the inerted turbo dryer 180.

Generally, the powder entering the turbo dryer 180 is at a temperature in the range of from ambient water tap temperature to about 70° C.

Finally, the powder leaving the inerted turbo dryer 180 at the outlet 190 is preferably at a temperature of about 60° C. at which the powder is not too reactive, it being understood that at higher temperatures, powder is more reactive than at lower temperatures, particularly powder in the 1-10 micron range, which is the preferred particle size as determined by BET measurement after the particles forming the powder exit the calciner 130. As understood from the incorporated patents, metal particles coming out of the reactor 15 generally have average diameters in the range of from about 0.1 to about 1 micron as calculated from BET surface area measurement. However, these particles are too small for many powder metallurgy usages and therefore, need to be grown which is the purpose of the calciner 130. Although maintaining the powder at elevated temperatures causes the particles to grow so that some growth takes place in the filter 115, the distillation conveyor 120 and thereafter during transfer to the heat calciner 130, the majority of the particle growth occurs in the calciner 130, with temperatures for CP titanium or titanium 6/4 alloy of about 750° C. and a residence time of about 6 hours. The system 10, can be designed for various production rates and the equipment dimensions and operating conditions will change as will be understood by an engineer of ordinary skill in this art. Although argon has been indicated as the preferred inert gas, if the temperatures are maintained low enough, nitrogen can be used without deleteriously affecting the powder as well as neon or other inert gases. Although designed herein without blowers, the cake silos 151 and 152 may need blowers in order to circulate additional air to passivated the cake produced from the cooling and passivation conveyor 135. Moreover, passivation could take place by means of contacting the powder after cooling with a mixture of an inert gas and up to about 20% oxygen in countercurrent relationship, but the method before described is preferred.

It should be understood that material entering the cooling and passivation conveyor 135 is under a protective atmosphere from the heat treatment calciner 130 but exits through the conveyor exit 136 at lower temperatures and with some air being present. An alternative method for passivation is to introduce the powder directly into the washing and drying system 19 rather than using first air passivation and thereafter washing. It is preferred to use air passivation first and then washing after passivation, but it may be preferable for reasons of cost and economy, immediately to wash after the powder comes out of the cooling passivation conveyor 135. Although air passivation followed by washing provides a lower oxygen concentration, for instance 900 ppm for CP titanium, that corresponds to ASTM B265 grade 1 titanium, whereas direct water washing (water and/or brine) without air passivation has provided oxygen concentrations of about 1800 ppm. The lower oxygen content may not always be required, depending upon the end use of the powder. Therefore, either water and/or brine passivation directly or air passivation directly may be employed or a combination thereof, that is air passivation followed by washing in which some passivation be used.

While the invention has been particularly shown and described with reference to a preferred embodiment hereof, it will be understood by those skilled in the art that several changes in form and detail may be made without departing from the spirit and scope of the invention.

What is claimed is:

1. A method of producing a friable, passivated metal powder, comprising the steps of:

introducing a metal halide vapor into a stream of liquid metal present in stoichiometric excess, wherein the stream of liquid metal is selected from the group consisting of alkali metals, alkaline earth metals, or mixtures thereof, to thereby form a reaction zone in which the metal halide vapor is reduced by the liquid metal to form reaction products;

separating substantially all of the excess liquid metal from the reaction products, wherein the reaction products include a metal powder;

growing the metal powder until particles forming the metal powder have average diameters calculated from BET surface area measurement of greater than about one micron;

cooling the metal powder; and directly contacting the cooled metal powder with a passivating agent to thereby provide a passivated and friable metal powder, the passivating agent selected from the group consisting of water and brine.

2. The method of claim 1, wherein the metal present in the metal halide vapor is one or more of Ti, Al, Sn, Sb, Be, B, Ta, Zr, V, Nb, Mo, Ga, U, Re, Si or alloys thereof.

3. The method of claim 2, wherein the separation step further includes distilling the reaction products under vacuum and further wherein the growing step includes maintaining the powder at an elevated temperature under vacuum or at an elevated temperature under an inert atmosphere until the average particle size of the metal powder as calculated from BET surface area measurement is at least about one micron.

4. The method of claim 2, wherein the separation step further includes contacting the reaction products with an inert gas sweep and further wherein the growing step includes maintaining the powder at an elevated temperature until the average particle size of the metal powder as calculated from BET surface area measurement is at least about one micron.

5. The method of claim 2, wherein the metal powder is moving during at least most of the growing and cooling steps.

6. The method of claim 2, further comprising the step of washing the passivated and friable metal powder.

7. The method of claim 6, wherein the passivated and friable metal powder is washed by contact with brine and/or water while the passivated and friable metal powder is transported by a filter belt.

8. The method of claim 7, wherein the washed passivated and friable metal powder is dried under an inert atmosphere.

9. The method of claim 6, wherein the passivated and friable metal powder is at least partly washed by at least two contacts with brine having at least two or more concentrations of salt.

10. The method of claim 1, wherein the metal powder is an alloy and the halide is a chloride.

11. The method of claim 1, wherein the metal halide vapor is reduced at greater than atmospheric pressure.

12. A method of producing a friable, passivated metal powder, comprising the steps of:

introducing a metal halide vapor of the metal into a stream of liquid metal present in stoichiometric excess, wherein the stream of liquid metal is selected from the group consisting of liquid sodium, liquid magnesium metal, and mixtures thereof, to thereby form a reaction zone in which the metal halide vapor is reduced by the liquid metal to form reaction products;

separating substantially all of the excess liquid metal from the reaction products, wherein the reaction products include a metal powder;

maintaining the metal powder at an elevated temperature for a time sufficient to grow the metal powder until particles forming the metal powder have average diameters calculated from BET surface area measurement of greater than about one micron;

cooling the metal powder to less than about 100$^{0}$C; and directly contacting the cooled metal powder with a passivating agent to thereby provide a passivated and friable metal powder, the passivating agent selected from the group consisting of water and brine.

13. The method of claim 12, wherein the metal powder is a transition metal or an alloy thereof.

14. The method of claim 13, wherein the transition metal is Ti or an alloy thereof.

15. The method of claim 14, wherein the reaction occurs at a pressure of from about one to about three atmospheres.

16. The method of claim 12, wherein the separation of most of the liquid sodium or magnesium metal from the reaction products includes filtration and/or distillation.

17. The method of claim 12, wherein the metal powder is maintained at a temperature of not less than about 700° C. for at least a portion of the growth of the metal powder particles.

18. The method of claim 17, wherein the metal powder is cooled on a conveyor from elevated temperature to not greater than about 80° C. prior to passivation.

19. The method of claim 18, further comprising a step of washing the passivated and friable metal powder with a washing agent selected from the group consisting of water, brine, or mixtures thereof.

20. The method of claim 19, wherein substantially all of the passivation and washing occur while the metal powder is on a conveyor.

21. The method of 20, wherein at least a portion of the growth in size of the particles forming the metal powder occurs in a rotatable drum.

22. The method of claim 19, further comprising a step of drying the passivated and friable metal powder in an inert atmosphere after washing the passivated and friable metal powder.

23. A method of producing a friable, passivated Ti or Ti alloy powder having an oxygen concentration of less than about 1800 parts per million (ppm), comprising the steps of:

introducing a metal halide vapor of Ti or the metal constituents of the alloy into a stream of a liquid metal present in stoichiometric excess, wherein the stream of liquid metal is selected from the group consisting of liquid alkali metals, liquid alkaline earth metals, and mixtures thereof, to thereby form a reaction zone in which the metal halide vapor of Ti is reduced by the liquid metal to form reaction products;

separating substantially all of the excess liquid metal from the reaction products, wherein the reaction products include a Ti or Ti alloy powder;

maintaining the Ti or Ti alloy powder at elevated temperature for a time sufficient to grow particles forming the Ti or Ti alloy powder to average diameters calculated from BET surface area measurement of greater than about one micron;

cooling the Ti or Ti alloy powder; and directly contacting the cooled Ti or Ti alloy powder with one or more passivating agents to thereby provide a passivated and friable Ti or Ti alloy powder having an oxygen concentration below about 1800 ppm, the passivating agent selected from the group consisting of water and brine.

24. The method of claim 23, further comprising a step of washing the passivated and friable Ti or Ti alloy powder with a washing agent selected from the group consisting of water, brine, or mixtures thereof.

25. The method of claim 24, wherein the washing agent comprises water and the water is de-ionized prior to washing.

26. The method of claim 24, wherein the washing agent comprises water and the water is de-oxygenated prior to washing.

27. The method of claim 23, wherein the Ti or Ti alloy powder is held at an elevated temperature for a time sufficient to grow the particles forming the Ti or Ti alloy powder to average diameters calculated from BET surface area measurement in the range of from about 1 to about 10 microns.

28. The method of claim 23, wherein the Ti or Ti alloy powder is held at an elevated temperature of at least about 700° C. during at least most of the growing times of the particles forming the Ti or Ti alloy powder.

29. The method of claim 23, wherein the Ti or Ti alloy powder is cooled to temperature of about 80° C. or less before the Ti or Ti alloy powder is passivated.

30. The method of claim 23, wherein the reaction products include salt and residual liquid metal.

31. The method of claim 23, wherein the metal halide vapor of Ti includes titanium tetrachloride, the liquid metal includes sodium or magnesium, and the temperature of the liquid metal downstream from the reaction zone is about 200° C. above the melting point of the metal used to reduce the halide vapor of Ti.

32. The method of claim 31, wherein the method is continuous.

33. The method of claim 32, wherein the separation is at least in part by distillation conducted under vacuum at temperatures of less than about 550° C. when the liquid metal is sodium.

34. The method of claim 32, wherein the separation is at least in part by passing a hot inert gas in contact with at least a portion of the reaction products to remove a portion of residual liquid metal present in the reaction products.

35. The method of claim 32, wherein the liquid metal is liquid sodium.

36. The method of claim 35, wherein the Ti or Ti alloy powder is continuously moving during substantially the entire steps of growing and cooling.

37. The method of claim 36, wherein the liquid sodium is at a temperature of less than about 300° C. prior to introduction of the metal halide vapor of Ti and the liquid sodium is maintained at a temperature of less than about 400° C. downstream from the reaction zone until separation of the liquid sodium from the reaction products begins.

38. A method of producing a friable, passivated Ti or Ti alloy particles having an oxygen concentration of less than about 900 parts per million (ppm), comprising the steps of:

introducing a metal halide vapor of Ti or the metal constituents of the alloy at sonic velocity or greater into a stream of liquid metal present in stoichiometric excess, wherein the stream of liquid metal is selected from the group consisting of liquid alkali metals, liquid alkaline earth metals, and mixtures thereof, to thereby form a reaction zone in which the metal halide vapor of Ti is reduced by the liquid metal to form reaction products;

separating by filtration and distillation substantially all of the excess liquid metal from the reaction products, wherein the reaction products include Ti or Ti alloy powder which are present under at least a partial vacuum;

maintaining the Ti or Ti alloy powder at elevated temperature in a vacuum or an inert atmosphere or a combination thereof for a time sufficient to grow the particles forming the Ti or Ti alloy powder to average diameters calculated from BET surface area measurement of greater than about one micron;

cooling the Ti or Ti alloy powder to a temperature of about 80° C. or less;

directly contacting the cooled Ti or Ti alloy powder with one or more passivating agents to thereby provide a passivated and friable Ti or Ti alloy powder having an oxygen concentration below about 900 ppm, the passivating agent selected from the group consisting of water and brine; and washing the passivated and friable Ti or Ti alloy powder to produce a washed, passivated, and friable Ti or Ti alloy powder, wherein the washing removes undesirable constituents from the reaction products.

39. The method of claim 38, wherein the passivated and friable Ti or Ti alloy powder is washed with a washing agent selected from the group consisting of de-ionized water, de-oxygenated water, brine in varying concentrations, and combinations thereof.

40. The method of claim 39, wherein the liquid metal is liquid sodium present in the range of from about 10 to about 100 times the stoichiometric amount required to reduce the metal halide vapor of Ti.

41. The method of claim 40, wherein the liquid sodium is at a temperature of less than about 300° C. prior to introduction of the metal halide vapor of Ti and the liquid sodium is maintained at a temperature of less than about 400° C. downstream from the reaction zone until separation of the liquid sodium from the reaction products begins.

42. The method of claim 41, wherein the Ti or Ti alloy powder is heated to an elevated temperature of at least about 700° C. under an inert atmosphere for a time sufficient such that the average diameters of the particles forming the Ti or Ti alloy powder calculated from BET surface area measurement are in the range of from about 1 to about 10 microns.

43. The method of claim 42, wherein the Ti or Ti alloy powder is maintained in an inert atmosphere during substantially the entire cooling step prior to the beginning of the passivation step.

* * * * *